US007882848B2

(12) United States Patent
Diamond

(10) Patent No.: US 7,882,848 B2
(45) Date of Patent: Feb. 8, 2011

(54) WALKER GLIDE

(75) Inventor: Harvey Diamond, Armonk, NY (US)

(73) Assignee: Drive Medical Design and Manufacturing, Port Washington, NY (US)

( * ) Notice: Subject to any disclaimer, the term of this patent is extended or adjusted under 35 U.S.C. 154(b) by 31 days.

(21) Appl. No.: 11/903,648

(22) Filed: Sep. 24, 2007

(65) Prior Publication Data

US 2009/0078296 A1 Mar. 26, 2009

(51) Int. Cl.
*A45B 9/04* (2006.01)

(52) U.S. Cl. ..... 135/77; 135/78

(58) Field of Classification Search ..... 135/77, 135/78; 16/42 T, 42 R
See application file for complete search history.

(56) References Cited

U.S. PATENT DOCUMENTS 5,452,888 A * 9/1995 Glenn ..... 473/424
5,485,862 A * 1/1996 Kahn ..... 135/77
5,573,213 A 11/1996 Henderson et al.
5,692,762 A 12/1997 Obitts
5,711,335 A 1/1998 Carpinella
5,778,605 A 7/1998 Ellena et al.
5,810,038 A 9/1998 Carpinella
5,911,235 A 6/1999 Henderson et al.
2003/0226585 A1 12/2003 Burchel
2004/0040105 A1 * 3/2004 Hillenbrand ..... 15/104.001
2005/0205122 A1 9/2005 Bly et al.
2006/0053587 A1 * 3/2006 Chase ..... 16/42 R
2006/0272691 A1 12/2006 DeLesline

* cited by examiner

*Primary Examiner*—David Dunn
*Assistant Examiner*—Danielle Jackson
(74) *Attorney, Agent, or Firm*—Carter, DeLuca, Farrell & Schmidt, LLP

(57) ABSTRACT

A walker glide having a hollow body with a substantially semi-spherical shape, a top opening and a removable bottom element that are arranged along a common axis. A sleeve is arranged in the hollow body so as to extend from the top opening toward the bottom element. A mounting element is attached to an upper side of the bottom element and is releasably attachable to a lower end of the sleeve whereby the bottom element is replaceable.

13 Claims, 4 Drawing Sheets

WALKER GLIDE

BACKGROUND OF THE INVENTION

The present invention relates to a glide that is used to fit on the bottom of the legs of a walker to make it easier for a person to move the walker during use.

Walkers are well known products available for the handicapped and individuals weakened or recovering from injury.

Walkers are generally comprised of a metal frame that has two sides each having a pair of parallel legs that extend to the ground or floor generally at the corners of a rectangle, to define two front legs and two rear legs.

At least two of the legs have rubber or plastic tips mounted at their end so as to permit sliding of the legs across the underlying surface. In many instances the two front legs have wheels which provide a rolling motion and the rear legs slide along the underlying surface as the walker is moved.

The problem with these tips at the ends of the legs is that they wear out. A number of tips or glides have been presented in the prior art as evidenced by U.S. Pat. Nos. 5,778,605; 5,573,213; 5,818,038; 5,911,235; 5,711,335, among others. Additionally, U.S. Patent Application Publications US 2006/0272691 and US 2003/0226585 show boots or covers for walker legs.

Furthermore, many individuals simply use a conventional tennis ball to cover the tip of the leg. To do this, they merely cut a slot in the tennis ball and squeeze it over the leg. The problem with this solution is that over time the fleece cover of the tennis ball wears out which requires replacement of the entire tennis ball.

SUMMARY OF THE INVENTION

Accordingly, it is an object of the present invention to provide an improved walker glide which has a replaceable bottom element which allows the glide to be reused by simply replacing the bottom element when it is worn out.

Pursuant to this object, and others which will become apparent hereafter, once aspect of the present invention resides in a walker glide having a hollow body with a substantially spherical shape. The hollow body has a top opening, bottom opening and a removable bottom element that are arranged along a common access. A sleeve is arranged in the hollow body so as to extend from the top opening in the direction of the bottom opening and element. The inner diameter of the sleeve is dimensioned so as to fit over the leg of a walker. A mounting element is attached to an upper side of the bottom element. The mounting element is releasably attachable to a lower end of the sleeve thereby making the bottom element replaceable.

In another embodiment of the invention the hollow body is made of a resilient material. In still another embodiment the hollow body is formed from a tennis ball.

The upper end of the sleeve has a collar that is contoured to substantially match the contour of the outer surface of the hollow body. An annular lip is provided on the sleeve at a distance from the collar so as to form a gap into which an edge of the hollow body formed by the top opening engages. The sleeve is thus connected to the hollow body by the edge of the hollow body engaging in the gap between the collar and the lip. For additional security an adhesive can be provided in the gap to facilitate holding of the hollow body material.

The bottom of the sleeve has a through-hole therein that runs along the central axis of the sleeve. The mounting element has a peg dimensioned to fit into the through hole with a friction fit so that when the sleeve and the hollow body are connected together, the mounting element, with the attached bottom element, can be releasably connected to the sleeve via the friction fit of the peg in the hole in the bottom of the sleeve.

In order to facilitate manufacturing it is desirable for the sleeve and the mounting element to be made of plastic.

In another embodiment of the invention, the mounting element has a dish shaped part with an outer surface contoured to substantially match the contour of the shape of the hollow body, i.e. complete the spherical shape of the tennis ball. The peg is attached to an inner surface of the dish shaped element for mounting to the sleeve as discussed above.

In still a further embodiment of the invention indicia are provided on the outer surface of the hollow body for any desired purpose, such as advertising or safety warnings.

Other features and advantages of the present invention will become apparent from the following description of the invention that refers to the accompanying drawings

DETAILED DESCRIPTION OF THE INVENTION

Figure 1:
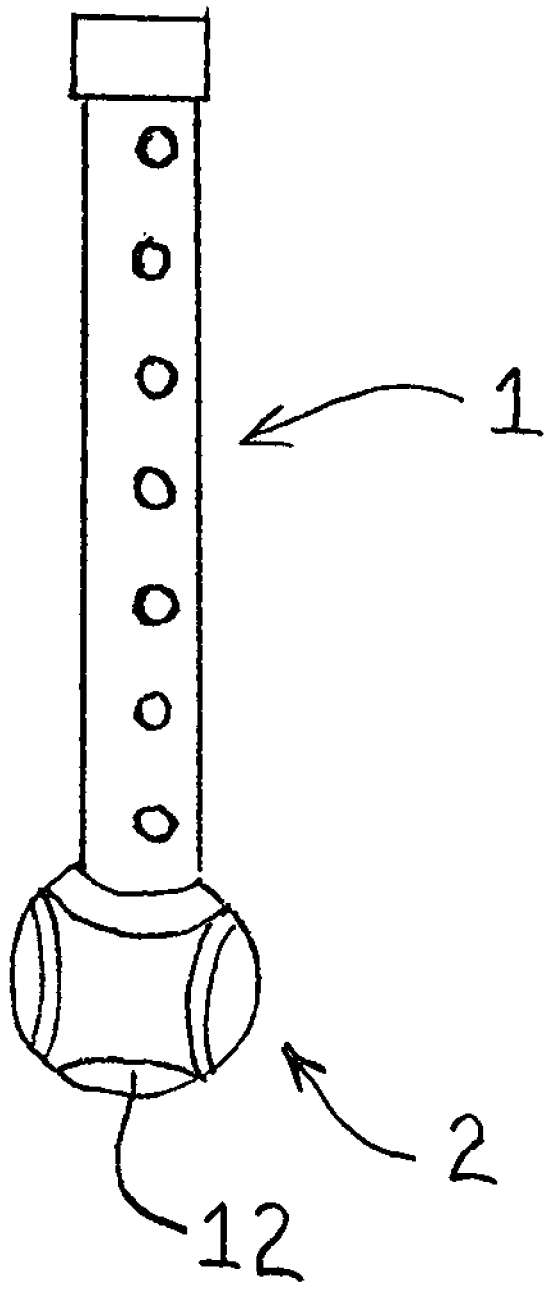
FIG. 1 is a view showing the inventive walker glide mounted on the leg of a walker.

FIG. 1 shows the inventive walker glide 2 mounted on a leg 1 of a walker.

Figure 2:
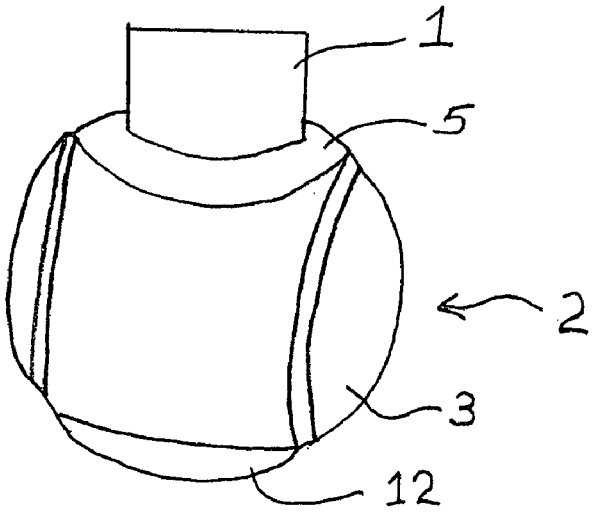
FIG. 2 is an enlarged perspective view of the walker glide on the walker leg.
Figure 3:
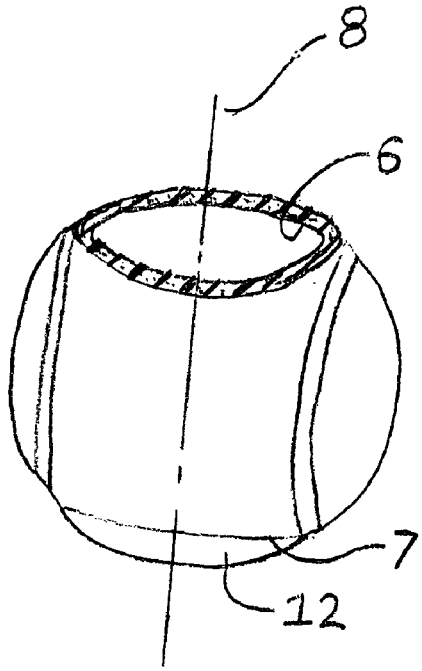
FIG. 3 is a view as in FIG. 2 without the sleeve and walker leg.

FIGS. 2 and 3 show an enlarged perspective view of the glide 2, in which it can be seen that the body 3 of the glide is formed by a tennis ball. The body has an upper hole 6 and a lower hole 7 arranged along a common axis 8 through the hollow body. A sleeve 4 has a collar 5 at one end and an annular flange 9 arranged at a distance from the collar 5 so as to form a gap which accepts the edge of the hollowed body 3 formed by the hole 6.

The sleeve is inserted through the upper hole 6 so that the peripheral edge of the body 3 that defines the hole 6 snaps into the gap between the annular flange 9 and the collar 5. The collar 5 is contoured so as to substantially conform to the outer contour of the spherical body 3.

Figure 4:
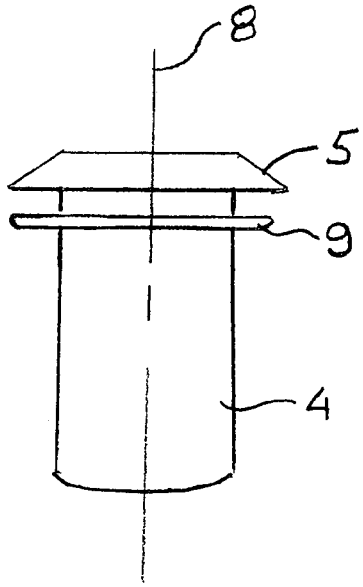
FIG. 4 is a side view of the sleeve.
Figure 5:
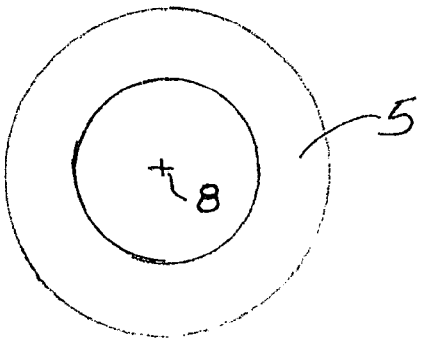
FIG. 5 is a top view of the sleeve.
Figure 6:
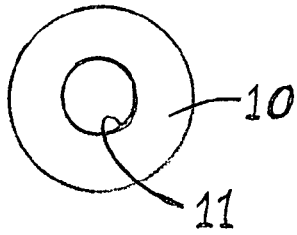
FIG. 6 is a bottom view of the sleeve.

As shown in FIGS. 4-6, the sleeve 4 and collar 5 are circular. Furthermore, the sleeve 4 has an inner diameter so as to accept the leg of a walker. The bottom 10 of the sleeve 4 is provided with a hole 11 that is on the same axis 8 as the holes 6, 7 in the spherical body 3. It is understood that the sleeve and collar can have other shapes which would also be suitable.

Figure 7:
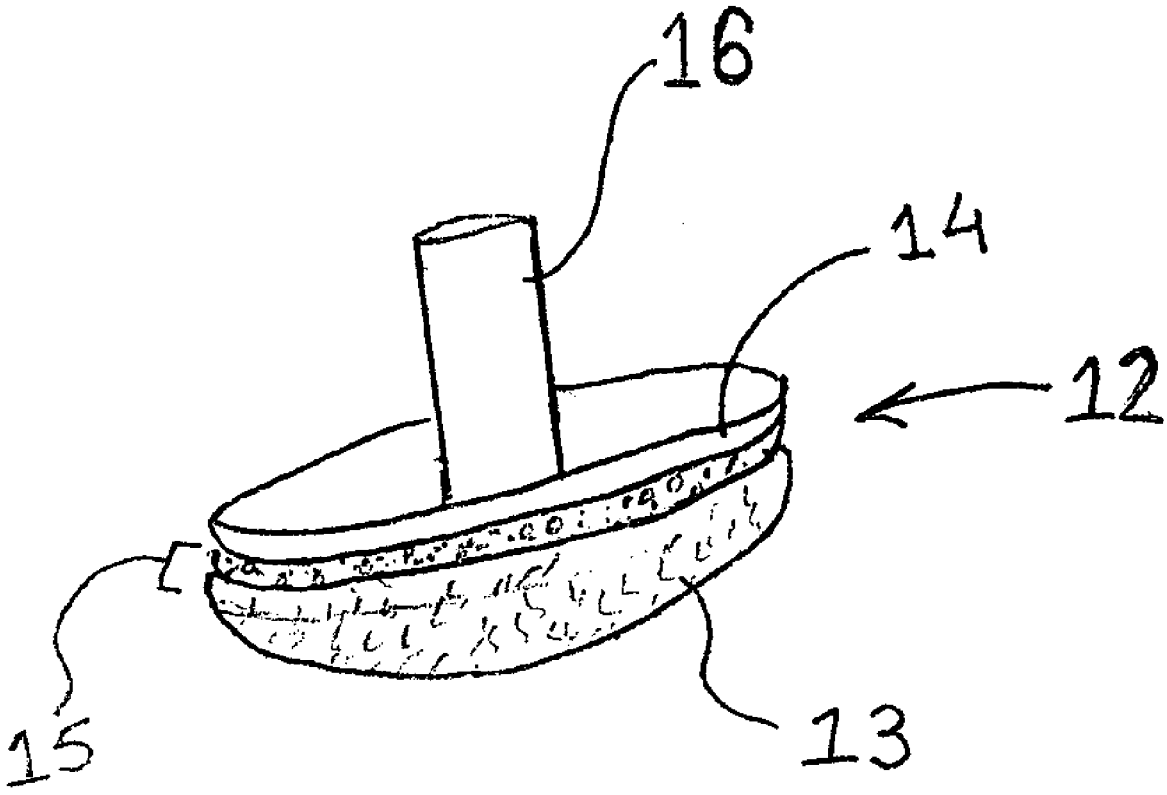
FIG. 7 is a perspective view of the removable bottom element.

FIG. 7 shows the bottom element 12 which forms the actual gliding surface of the glide. The bottom element 12 is removably attached to the sleeve 4 so that when the outer surface 13 wears out, the bottom element 12 can be easily removed and replaced with a new bottom element. In addition to the outer surface 13, the bottom element has a dish shaped part 14 that has an outer surface which is contoured to correspond substantially to the spherical shape of the body 3. A layer 15 of tennis ball material is mounted to the outer surface of the dish shaped part 14 so that when the bottom element is mounted in the sleeve, the outer surface 13 conforms to the outer surface of the sphere formed by the body 3, as shown in FIG. 2. A peg

16 is centrally provided on dish shaped part 14 so as to project vertically therefrom. The peg 16 is dimensioned so as to fit in the hole 11 in the bottom 10 of the sleeve 4 with a frictional fit.

The peg 16 projects into the interior of the sleeve 4 so that the bottom element 12 can be removed from the sleeve by simply pressing against the end of the peg 16 to force it out of the hole 11 in the bottom of the sleeve.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A walker glide, comprising:

a hollow body having a substantially spherical shape, the hollow body including a top opening and a bottom opening;

a sleeve arranged in the hollow body so as to extend from the top opening toward the bottom opening, an upper end of the sleeve having a collar contoured to substantially match a contour of the shape of the hollow body, the collar extending out from an outer surface of the sleeve; and a bottom element, the bottom element including a mounting element attached to an upper side thereof, the mounting element being removably attachable to a lower end of the sleeve to removably attach the bottom element to the hollow body along a common axis;

wherein an annular lip is provided on the sleeve at a distance from the collar so as to form a gap into which an edge of the hollow body formed by the top opening fits.

2. A walker glide as in claim 1, wherein the hollow body is resilient.

3. A walker glide as in claim 2, wherein the hollow body is formed from a tennis ball.

4. A walker glide as in claim 3, and further comprising surface indicia on an outer surface of the tennis ball.

5. A walker glide as in claim 1, wherein the edge of the hollow body is glued in the gap between the annular lip and the collar.

6. A walker glide as in claim 1, wherein the lower end of the sleeve has a hole therein.

7. A walker glide as in claim 6, wherein the mounting element includes a peg dimensioned to fit in the hole in the sleeve with a friction fit.

8. A walker glide as in claim 7, wherein the mounting element is made of plastic.

9. A walker glide as in claim 7, wherein the mounting element includes a dish-shaped part having an outer surface contoured to substantially match a contour of the shape of the hollow body, the peg being attached to an inner surface of the dish-shaped part.

10. A walker glide as in claim 6, wherein the sleeve is made of plastic.

11. A walker glide as in claim 1, wherein the sleeve has an inner diameter dimensioned so that a leg of a walker is insertable therein.

12. A walker glide as in claim 1, wherein the sleeve has a circular cross-section.

13. A walker glide, comprising:

a hollow body having a substantially spherical shape, the hollow body including a top opening and a bottom opening;

a sleeve arranged in the hollow body so as to extend from the top opening toward the bottom opening, an upper end of the sleeve having a collar contoured to substantially match a contour of the shape of the hollow body, the collar extending out from an outer surface of the sleeve; and a bottom element, the bottom element including a mounting element attached to an upper side thereof, the mounting element being releasably attachable to a lower end of the sleeve to removably attach the bottom element to the hollow body along a common axis;

wherein the lower end of the sleeve has a hole therein;

wherein the mounting element includes a peg dimensioned to fit in the hole in the sleeve with a friction fit;

wherein the bottom element includes a dish-shaped part having an outer surface contoured to substantially match a contour of the shape of the hollow body, the peg being attached to an inner surface of the dish-shaped part; and wherein the bottom element includes a portion of a tennis ball cover covering the outer surface of the dish-shaped part.

* * * * *